United States Patent [19]

Bessho

[11] 4,148,209

[45] Apr. 10, 1979

[54] FORGING PRESS

[75] Inventor: Michio Bessho, Hyogo, Japan

[73] Assignee: Kawasaki Yukoh Kabushiki Kaisha, Hyogo, Japan

[21] Appl. No.: 894,558

[22] Filed: Apr. 7, 1978

[51] Int. Cl.[2] ..... B21J 7/28

[52] U.S. Cl. ..... 72/441; 72/444; 72/445; 72/446; 72/453.03

[58] Field of Search ..... 72/441, 444, 445, 446, 72/450, 432, 453.01, 453.02, 453.03, 453.11, 453.13, 453.18; 100/257

[56] References Cited

U.S. PATENT DOCUMENTS

| | | | |
|---|---|---|---|
| 683,374 | 9/1901 | Beche | 72/453.03 |
| 689,051 | 4/1911 | Roberts | 72/453.03 |
| 1,713,974 | 5/1929 | Massey | 72/453.03 |
| 3,783,672 | 1/1974 | Morgolenko | 72/453.03 |

*Primary Examiner*—C. W. Lanham
*Assistant Examiner*—Gene P. Crosby

[57] ABSTRACT

This case discloses a forging press having a pump ram inserted into the upper part of a cylinder within a frame, a press ram into the lower part thereof, and a cavity filled with working oil provided between both parts of the cylinder for transmitting the mechanically given reciprocating motion of the pump ram to the press ram by the working oil, said forging press comprising a stopper provided outside the frame for mechanically controlling the upper limit position in reciprocating motion of the press ram and enabling an adjustment of the position where the stopper and corresponding portion of the press ram come into contact with each other, from outside during operating the press, wherein a controllable check valve for open-and-close operation is provided in the middle of oil passage which communicates with working oil supply source and working oil in the cylinder, for feeding or discharging oil into or from the supply source therethrough according to shortage or excess of oil quantity in the cylinder resulting from above-described adjustment of a contact position of the stopper.

2 Claims, 4 Drawing Figures

FORGING PRESS

DETAILED DESCRIPTION OF THE INVENTION

The present invention relates to a so-called hydraulic forging press and particularly to a forging press satisfactorily applicable to stamp forgings for which precision in dimension is strictly required.

Outlining at first the conventional types of forging presses, those equipped with various types of driving means have been used on the ground that the characteristic of hydraulic forging press resides in having advantages of both the so-called mechanical press which drives the ram with mechanical means and the so-called free forging type press which can change the impact level. However, in the conventional type forging press, a device for changing impact level is always based upon such principle that the change of impact level can be performed by increasing or reducing the quantity of working oil supplied between the upper ram and the lower one, i.e., forcing working oil into the cylinder from outside or discharging toward outside. These conventional means are considerably effective only for the so-called rough forging which primarily aims at forging to harden the material, but almost inapplicable to precision forging or stamp forging because of fundamental problems described as follows: When high precision in dimension is required with respect to the impact level, if the first impact level is designated, for example, at (a)m/m and the second one at (a−0.3)m/m and the conventional forging press as abovesaid is to be used, it becomes necessary to calculate a volume in the cylinder corresponding to the fall distance 0.3 m/m of the press ram and to feed oil from outside into the cylinder in quantity exactly corresponding to said calculated volume. It is easily understood that such procedures can hardly be achieved in an extreme short period of time. It cannot be helped to say that the conventional forging press has been almost unavailable in practical use for precision forging or stamp forging in respect of not only working speed but also keeping precision, even though probably available for rough forging.

The object of this invention is to provide a forging press in simple construction which operates with high precision and at high speed suitably for precision forging or stamp forging, thereby eliminating abovesaid demerits and defects in the conventional hydraulic forging press.

Describing briefly some characteristics of a forging press according to this invention, a device is so designed as to adjust mechanically from outside a newly designated impact level by means of the stopper and then to feed or discharge working oil into or from the space in the cylinder for containing working oil in quantity as much as required for bringing an impact level into agreement with the adjusted one, while change of impact level in the conventional forging press is made according to the quantity of working oil to be forced into or discharged from the cylinder.

Figure 1:
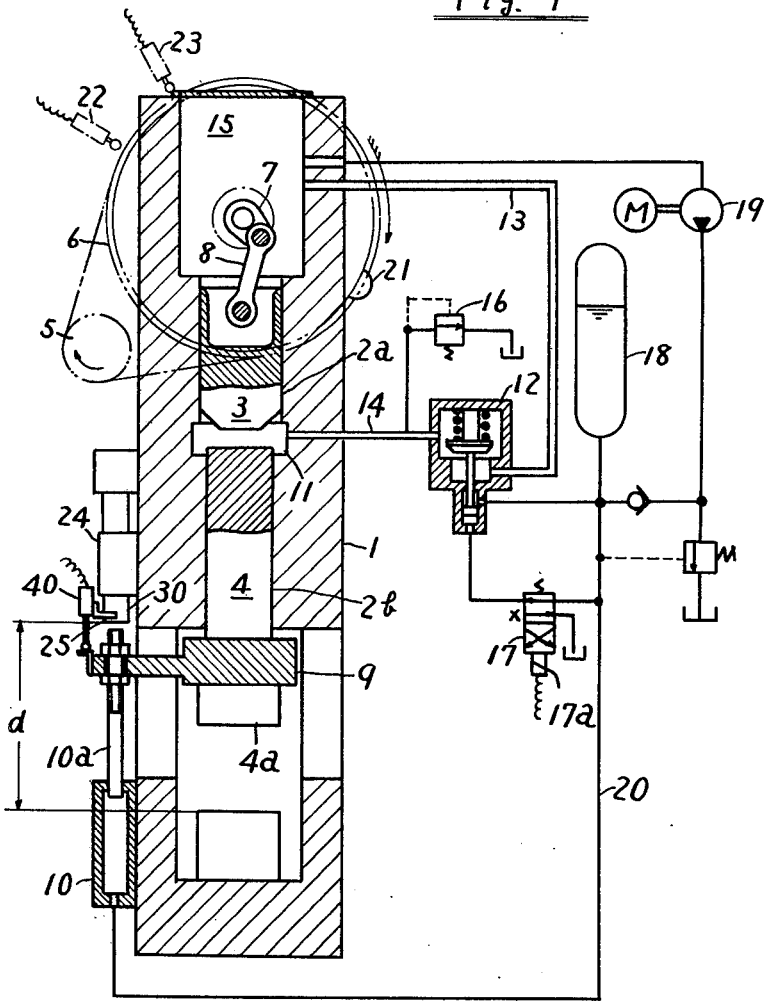
FIG. 1 is a schematic illustration showing one embodiment of this invention.

The drawing includes the following elements:

| | | | |
|---|---|---|---|
| 1. | frame | 2a, 2b. | cylinder |
| 3. | pump ram | 4. | press ram |
| 5. | motor | 6. | fly-wheel |
| 7. | crank shaft | 8. | connecting rod |
| 9. | slide | 10. | return cylinder |
| 10a. | push-up ram | 11. | cavity |
| 12. | check valve | 13, 14, 20. | Oil passage |
| 15. | tank | 16. | relief valve |
| 17. | changeover valve | 17a. | solenoid |
| 18. | pressure accumulator | 19. | pump |
| 21. | projection | 22, 23, 40. | limit switch |
| 24, 35. | stopper | 25. | working end surface |
| 26. | pulse motor | 27, 37. | gear |
| 28. | internally threaded intermediate | | |
| 29. | slide valve | 30, 34. | spacer |
| 31. | shell | 32, 33. | hole |
| 36. | pitch circle | 38. | rack |
| 39. | hydraulic pressure cylinder | | |

Next, referring to the drawings showing embodiments of this invention, the construction of forging press will be described in detail as follows: In FIG. 1, the numerical symbol 1 indicates the frame of forging press whose central portion is provided with internal cylinders 2*a* and 2*b* communicating with each other, the pump ram 3 and the press ram 4 being inserted into the upper cylinder 2*a* and the lower one 2*b* respectively. In the crown part of the frame 1, provided is a crank shaft 7 directly connected to a fly-wheel 6 continuously revolved by the motor 5 and mechanically as well as continuously lifting and lowering the pump ram 3 in a fixed distance of stroke through the connecting rod 8. The symbol 9 shows the slide firmly fixed to the press ram 4 and constrantly pushed upward by the return cylinder 10 through the push-up ram 10*a*. Working oil reserved in the tank 15 provided inside the crown part of the frame is fed into the cavity 11 formed between the pump ram 3 and the press ram 4 in the cylinders 2*a* and 2*b* through the pilot-operated check valve 12 and the oil passages 13 and 14. The symbol 16 indicates the relief valve which controls the maximum pressure of oil in the passage 14. The check valve 12 is usually kept open by the pressurized oil in the pressure accumulator 18 through the changeover valve 17. The symbol 19 indicates the pump for feeding working oil into the pressure accumulator 18, and 20 is the oil passage connecting the pressure accumulator 18 to the return cylinder 10.

When the check valve is open (as shown in the drawing), if the motor 5 is energized, the pump ram 13 reciprocates in a fixed distance of stroke and, nevertheless, the press ram 4 remains at the upper limit position and continues to be at rest, without being lowered against oil pressure in the return cylinder 10 on account of free flowing of working oil between the cavity 11 and the tank 15 through the passages 13 and 14.

When the push-button (not shown in the drawing) on the operation board is depressed, the solenoid 17*a* of the change-over valve 17 is actuated and therefore the changeover valve 17 is changed over from a position shown in the drawing to the other (adjoining lower one in the drawing), which consequently closes the check valve 12, blockades working oil in the cavity 11 and oil passage 14, transmits the reciprocating motion of the pump ram 3 to the press ram 4 through working oil in the cavity 11, and allows the performance of forming process upon the material to be forged by the bottom surface 4a of the press ram 4. Provided that a projection 21 is formed on the fly-wheel 6 so as to strike the push-button of the limit switch 23 earlier than the pump ram 3 reaches the upper limit position and the solenoid 17a is adapted to be actuated by a signal generated when the push-button is depressed by a strike of the projection 21, the timing to close the check valve 12 becomes accurate and the press ram 4 falls down exactly in a fixed distance of stroke. When output of the press ram exceeds the specified one during operation, the relief valve relieves the oil passage 14 of working oil, thus preventing overloaded operation. When continuous operation of the press with a fixed distance of stroke is required, it is made possible by keeping the check valve closed. When one-cycle operation of the press is desired, such a device as providing another limit switch 22 for demagnetizing, during rising of the pump ram 3, the solenoid 17a which acts upon the changeover valve 17 will meet the purpose.

The stopper 24 is secured to the outer surface of the frame 1 and the working end surface 25 thereof is disposed to face the upper end surface of the push-up ram 10a which is fixed to the one end of the slide 9 and reciprocates always integrally with the press ram 4. In this case, various types of customary means higherto normally used are applicable to the adjustment of dimension 'd' which defines the position of the working end surface 25, namely, where the stopper 24 and the push-up ram 10a come into contact with each other. However, referring to FIG. 2, one preferred embodiment will be introduced hereunder: The figure shows a mechanism of the stopper utilizing the servo cylinder; 26 being a pulse motor; 27, a gear secured to the motor shaft; 28, an internally threaded intermediate revolved by the gear 27; 29, a slide valve to be slid longitudinally depending on the revolution of the internally threaded intermediate; 30, a spacer to slide following sliding of the slide valve 29. The shell, slidably enclosing the spacer 30 and provided with holes 32 and 33 as vents for working oil, is an application of the generally known principle of servo cylinder in which the spacer 30 moves following the movement of the slide valve 29 through functioning of working oil. The position of the working end surface 25 of the spacer 30, i.e., the distance 'd' in terms of length, can be adjusted with high precision and further in a very short period of time by adapting the pulse motor 26 to turn at specified rpm.

Figure 3:
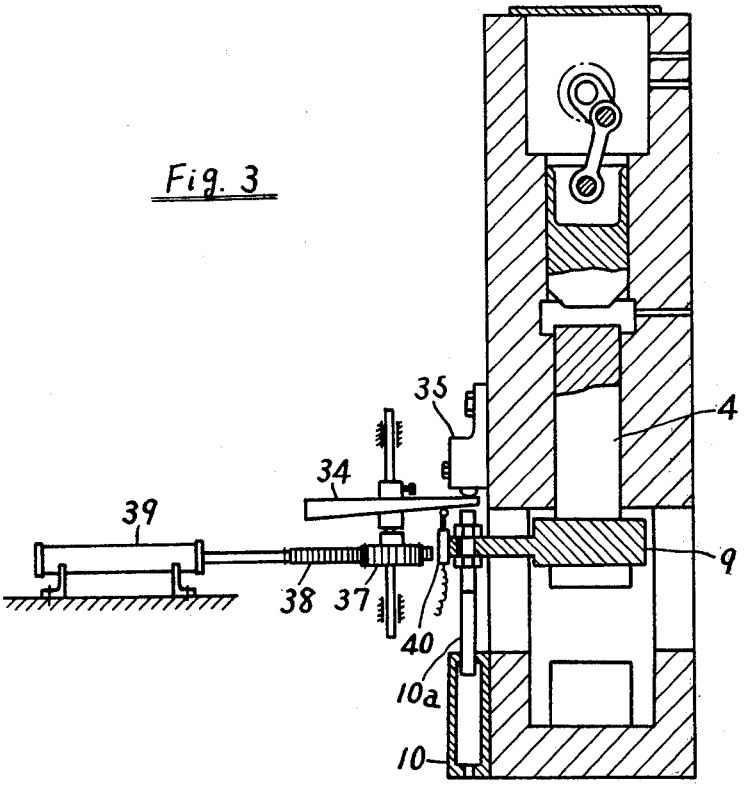
FIG. 3 is a schematic view showing another embodiment.
Figure 4:
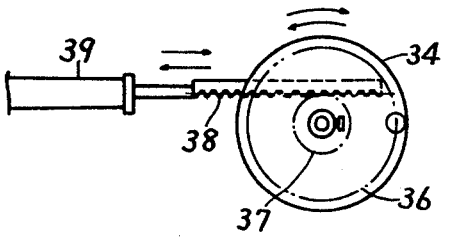
FIG. 4 is a plan showing the main portion of the embodiment shown in FIG. 3.

FIGS. 3 and 4 show other embodiments relating to the adjustment of contact position of the stopper, where 34 is a disc-shaped spacer interposed between the stopper 35 and the push-up ram 10a. The spacer 34 gradually varies in thickness with the circumference of pitch circle 36 thereof, (Note: This pitch circle is defined with plotted points where the stopper touches the spacer.) and is capable of turning in any degree through the gear 37 having a common axis with the spacer. The gear 37 is turned by the rack 38 through the hydraulic pressure cylinder 39. A mechanism in this embodiment is intended to adjust the upper limit position of the press ram 4 by inserting a wedge between the stopper 35 and the push-up ram 10a and adapting the wedge to be variable in thickness at the contact position of the stopper. In this case, the spacer 34 corresponds to a disc-shaped wedge. Therefore, a method to replace the spacer 34 with a linear wedge and to insert or withdraw said wedge with horizontal shifting between the stopper and the push-up ram is naturally applicable, though not shown in the drawing.

Figure 2:
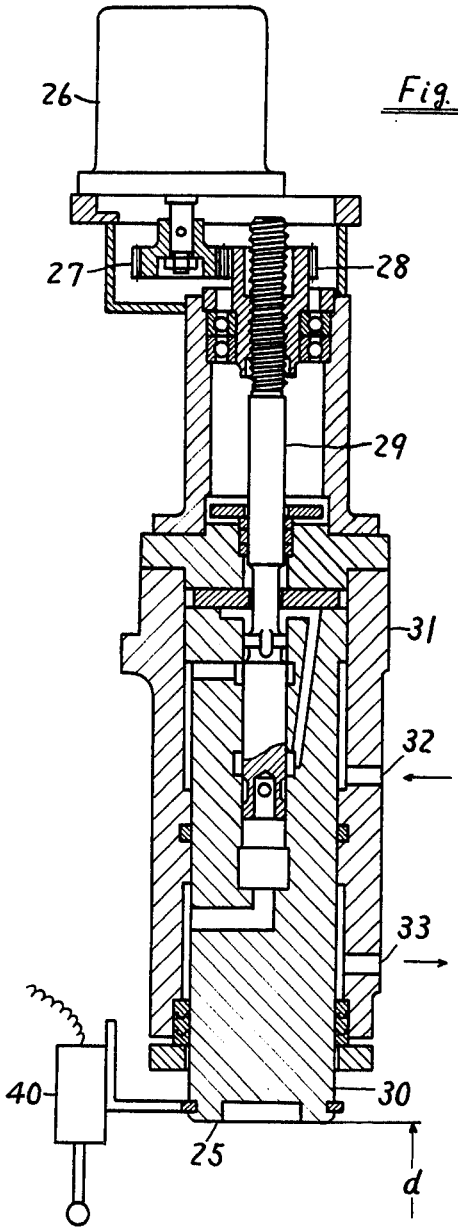
FIG. 2 is a vertical sectional view of the main portion thereof.

In FIGS. 1 to 3 inclusive, the symbol 40 indicates the limit switch provided near the contact position of the spacer 30 or 34 to the push-up ram 10a for the purpose of controlling the timing for enabling the spacer 30 or 34 to perform an operation for changing the impact level. When the next impact level is required to be lower than the present one, an adjustment will be made so that the dimension 'd' may be reduced in a specified degree by operating the spacer 30 or 34 of the stopper, depending upon the signal informing of the cut-off of contact in the limit switch 40 after the startup of down stroke or impact at this time. When the press ram 4, which has previously finished impact, starts rising again under such adjusted condition, it continues to rise to a position adjusted by the spacer of the stopper, and afterward the pump ram 3 alone continues upward stroke in the mechanically fixed distance to the dead point. As a result, the volume of cavity 11 increases and suction force generated thereby opens the check valve, when working oil in the tank 15 is added to the cavity 11 through the opened check valve 12 in quantity as much as required for determining the next impact level. When the pump ram 3 starts falling, the check valve 12 is automatically closed and downward stroke of the pump ram 3 exactly acts as that of the press ram 4. In this way, a fall distance determined with respect to the upper limit position in the stroke of the press ram can be used as that of impact level of the press ram quite exactly as it is. On the contrary, when the next impact level is required to be higher than the present one in a specified degree, working oil in the cavity 11 will be discharged during such operations as adjusting the dimension 'd' to be large as much as specified, the limit switch 22 to operate for opening the check valve 12 at the time of re-rising of the press ram 4 that has finished the previous impact, and the limit switch 23 to operate for closing the check valve 12. This discharge operation is continued during rising of the press ram 4 due to pushing up by the ram 10a and until the push-ram 10a stops when the upper end thereof comes into contact with the lower end of the spacer. Accordingly, the quantity of working oil in the cavity 11 is exactly reduced as small as required for the next impact.

Because of such construction of a forging press according to this invention as described above, an adjustment of impact level with high precision which has been quite unobtainable in the conventional forging press can be achieved, fully satisfying the requirements in dimension and accuracy for forgings to be produced by precision forging or stamp forging. Furthermore, since the adjusting operation in changing impact level can be easily, exactly, and optionally performed from outside during operating the press in a very short period of time with simple handling, the performance of continuous automatic pressing is also possible according to the impact level changing procedured present on the press control board, and the above-described results can be obtained without affecting the maintenance of high speed and high rate of operation cycle which are characteristics of this kind of forging press, which makes a great deal of contribution to the promotion of function of forging press and enlarging the variety of use.

I claim:

1. In a forging press having a pump ram inserted into the upper part of a cylinder within a frame, a press ram into the lower part thereof, and a cavity filled with working oil provided between both parts of the cylinder for transmitting the mechanically given reciprocating motion of the pump ram to the press ram by the working oil, said forging press comprising a stopper provided outside the frame for mechanically controlling the upper limit position in reciprocating motion of the press ram and enabling an adjustment of the position where the stopper and corresponding portion of the press ram come into contact with each other, from outside during operating the press.

2. A forging press as claimed in claim 1, wherein a controllable check valve for open-and-close operation is provided in the middle of oil passage which communicates with working oil supply source and working oil in the cylinder, for feeding or discharging oil into or from the supply source therethrough according to shortage or excess of oil quantity in the cylinder resulting from above-described adjustment of a contact position of the stopper.

* * * * *